US005771614A

United States Patent [19]

Dawson

[11] Patent Number: 5,771,614

[45] Date of Patent: Jun. 30, 1998

[54] FLORAL ASSEMBLY

[76] Inventor: Neil K. Dawson, 1145-B New Litchfield St., Torrington, Conn. 06790

[21] Appl. No.: 699,165

[22] Filed: Aug. 19, 1996

[51] Int. Cl.[6] ..... G09F 1/00

[52] U.S. Cl. ..... 40/124.06; 40/124.11; 47/56; 47/81

[58] Field of Search ..... 40/124.01, 124.06, 40/124.11, 124.13, 124.14, 539; 428/24, 25, 26; D11/149, 151; 47/66.3, 66.6, 56, 79, 81

[56] References Cited

U.S. PATENT DOCUMENTS

| | | | |
|---|---|---|---|
| D. 17,627 | 8/1887 | Carr | D11/151 |
| D. 149,252 | 4/1948 | Cobbs | D11/151 X |
| 3,018,586 | 1/1962 | Farley | 47/87 R X |
| 3,565,736 | 2/1971 | Jason | 428/24 X |
| 4,418,497 | 12/1983 | Mastriano | 47/56 X |
| 5,236,748 | 8/1993 | Cheng | 428/26 |
| 5,314,730 | 5/1994 | Flores | 428/24 |
| 5,435,085 | 7/1995 | Johnson | 40/124.06 |

OTHER PUBLICATIONS

"How To Make Flowers", Aug. 1951, pp. 1–3 and 6.

*Primary Examiner*—Brian K. Green
*Attorney, Agent, or Firm*—Dallett Hoopes

[57] ABSTRACT

A floral assembly, which may be included in a card, is made of absorbent paper in the shape of a flower having an upper end flared as a bloom-shaped seed pocket and the lower end is a stem-shaped support. The pocket contains seeds for germination and may be easily opened to free them for growth. When the stem is immersed in water, it serves as a wick to moisten the upper part of the assembly and helps start the seeds germinating.

2 Claims, 3 Drawing Sheets

FLORAL ASSEMBLY

FIELD OF THE INVENTION

This invention relates to a floral assembly. More specifically, the invention relates to a floral assembly which, when partly immersed in water, encourages the germination of seeds in the assembly. It may constitute part of a greeting card.

BACKGROUND OF THE INVENTION

The prior art includes a number of patents which disclose artificial flowers made of paper or the like. The art also discloses flowers as part of a greeting card or other display.

For example, a greeting card shown in the U.S. Pat. No. 1,885,879 issued Nov. 1, 1932 to L. M. Whittington provides a tube secured to the back of the card in which the stem of a flower may be inserted, the bloom of the flower protruding forwardly through an opening in the card above the tube.

The more recent Roberts et al U.S. Pat. No. 4,917,240 issued Apr. 17, 1990 encloses in a card a block of treated foam material into which flower stems can be inserted. Other U.S. Pat. Nos. disclosing cards for displaying cut flowers are 4,840,275 to Faiola et al granted Jun. 20, 1989 and Rentowl 4,584,213 granted Apr. 22, 1986.

Still other cards or assemblies provide means for germinating and growing seedlings from seeds and for displaying growing plants. For example, Holtkamp, Jr. U.S. Pat. No. 5,038,930 issued Aug. 13, 1991 has a windowed compartment for a growing plant. Mastriano U.S. Pat. No. 4,418,497 issued Dec. 6, 1983 provides a Christmas tree ornament in the form of an enclosure containing a shallow tray including seeds which germinate. Proctor U.S. Pat. No. 5,158,809 issued Oct. 27, 1992 presents a container enclosing seed material which, when opened and watered, makes a germination assembly for the seeds.

SUMMARY OF THE INVENTION

None of the prior art discloses a floral assembly, which may be included in a card, the assembly being made primarily of absorbent paper and in the shape of a flower having an upper end and a lower end. The upper end is a flared bloom-shaped seed pocket and the lower end is a stem-shaped support. The pocket contains seeds for germination and is easily opened to free them for growth. When the stem is immersed in water, it serves as a wick to moisten the upper part of the assembly and helps start the seeds germinating.

BRIEF DESCRIPTION OF THE DRAWINGS

Further objects and features of the invention will be apparent from the following specification and drawings which disclose preferred embodiments of the invention. In the drawings.

DESCRIPTION OF THE PREFERRED EMBODIMENT

Figure 1A:
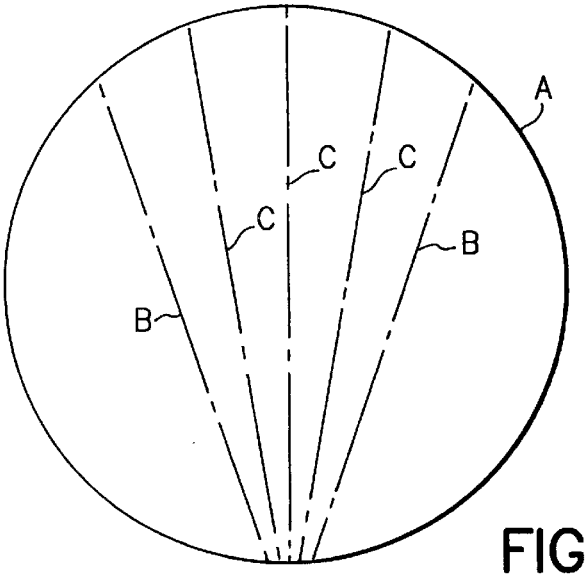
FIGS. 1*a* through 1*f* show progressive steps in making a preferred form of the invention.
Figure 1B:
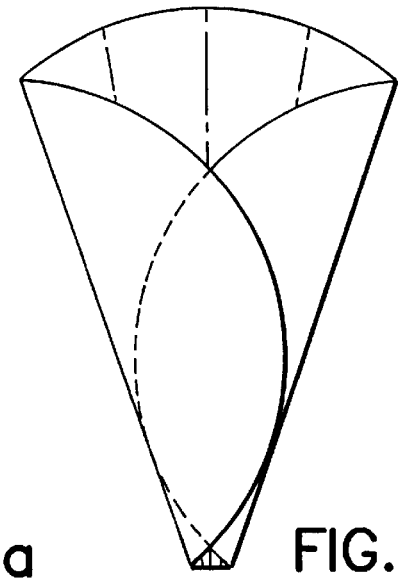
Figure 1C:
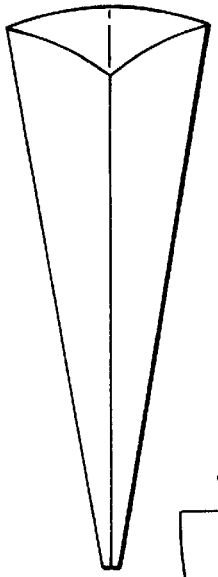
Figure 1D:
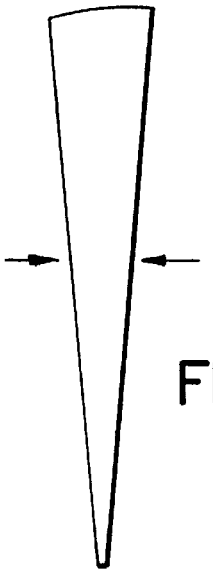
Figure 1E:
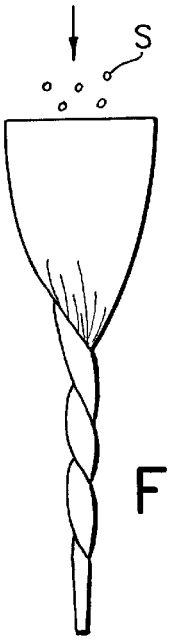
Figure 1F:
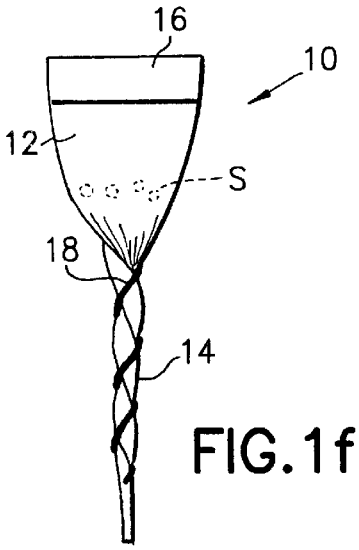

A floral assembly embodying the invention is shown in FIG. 1*f* and generally designated 10. It comprises a seed-germinating receptacle in the form of an artificial flower made of absorbent paper.

The assembly has an upper end 12 and a lower end 14. The upper end is in the form of a flared bloom-shaped seed pocket, the top 16 of which is folded over and affixed by cement to adjacent portions of the pocket to close it. The lower end 14 is a stem-shaped support and is made by gathering and twisting the lower portion of the assembly. Preferably a thin, stiff wire 18 is wound about the stem-shaped support to hold it in compressed twisted condition to more permanently hold its shape. Alternatively, an adhesive paper may hold the stem section compressed and rigid. The assembly, including seeds, is sometimes referred to herein as a "flower".

FIGS. 1*a* through 1*d* are illustrative of the making of the floral assembly. In FIG. 1*a* the basic material for the assembly comprises a disk of absorbent filter paper A which is circular and may be similar to the kind of paper that is used to filter coffee.

As an example, only for illustrative purposes, the paper disk may be folded along lines B to form the shape of FIG. 1*b*. Thereafter, the opposite sides of the form of FIG. 1*b* may be drawn together to form a kind of folded cone with edges comprising what were the fold lines C of FIG. 1*a*. The structure of FIG. 1*c* can be pinched at the center as symbolized by arrows in FIG. 1*d* and the lower portion thereof can be twisted as shown in FIG. 1*e* to replicate a supporting flower stem. With the lower end of the upper portion thus closed, seeds S may be inserted in the open top of the upper end as represented in FIG. 1*e*. Finally, the upper portion of the upper end can be flapped down as at 16 and cemented to close off the seed pocket with the seeds S nestled inside.

Figure 2:
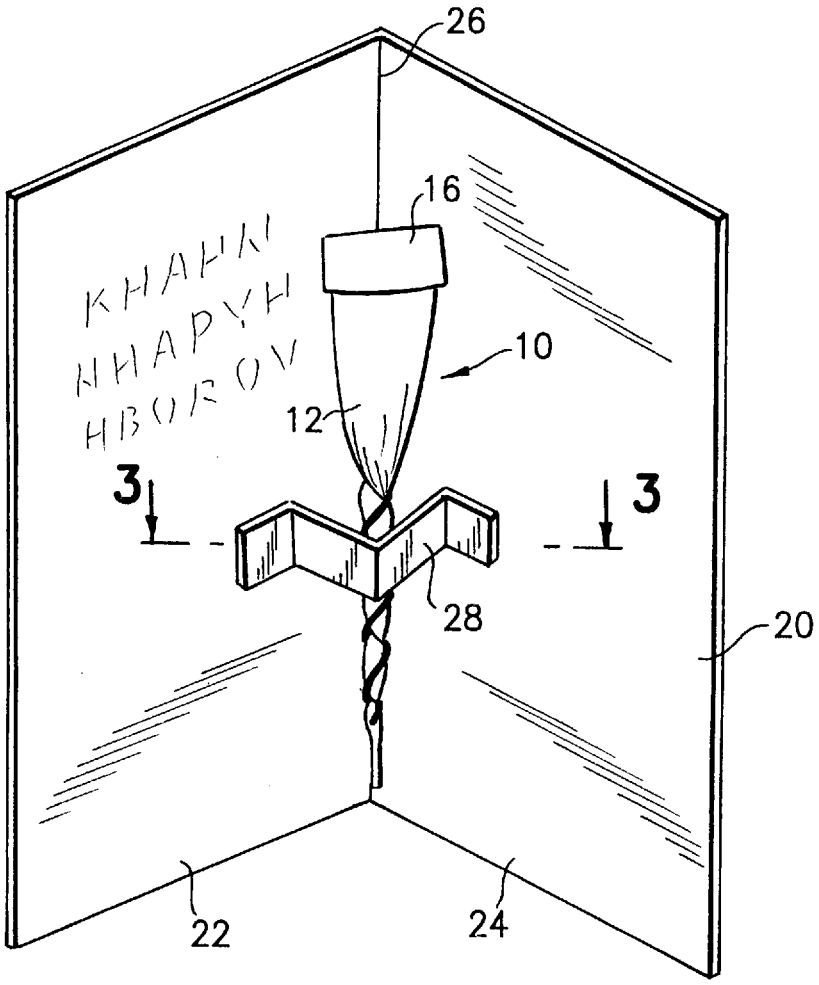
FIG. 2 shows a greeting card supporting a preferred embodiment of the floral assembly.
Figure 3:
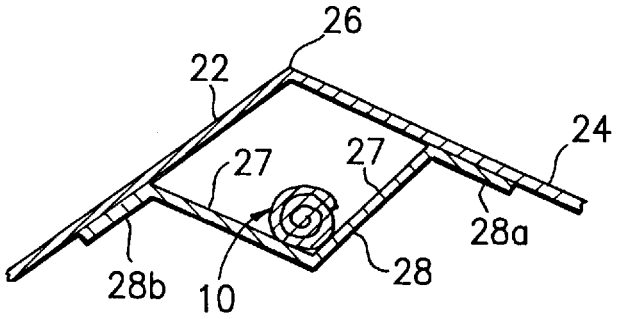
FIG. 3 is a fragmentary enlarged sectional view taken on the line 3—3 of FIG. 2.

FIG. 2 shows a greeting card 20 of the conventional folded variety, the card comprising a pair of panels 22 and 24 folded at a vertical fold line 26. A floral assembly support 28 is provided and shaped in top view like the letter "M" or "W" with arms 27 and end sections 28*a* and 28*b* attached to the panels 24 and 22 spaced above the lower ends thereof respectively (FIG. 2) respectively. This loosely supports the flower and leaves ample space within it, FIG. 3, for the support of the stem of the floral assembly 10.

Because of the bulk of the flared bloom-shaped seed pocket at the upper end 12, the stem can be positioned away from the fold line 26. As a result, the bloom-shaped upper end is not unduly compressed in its shape adjacent the fold line.

It will be understood that the greeting card including the floral assembly 10 shown in FIG. 2 may be readily closed and, in the process, flatten slightly the bloom-shaped seed pocket. This flattening does not damage the seeds, and, on opening, the pocket will tend to restore somewhat to its original shape.

Figure 4:
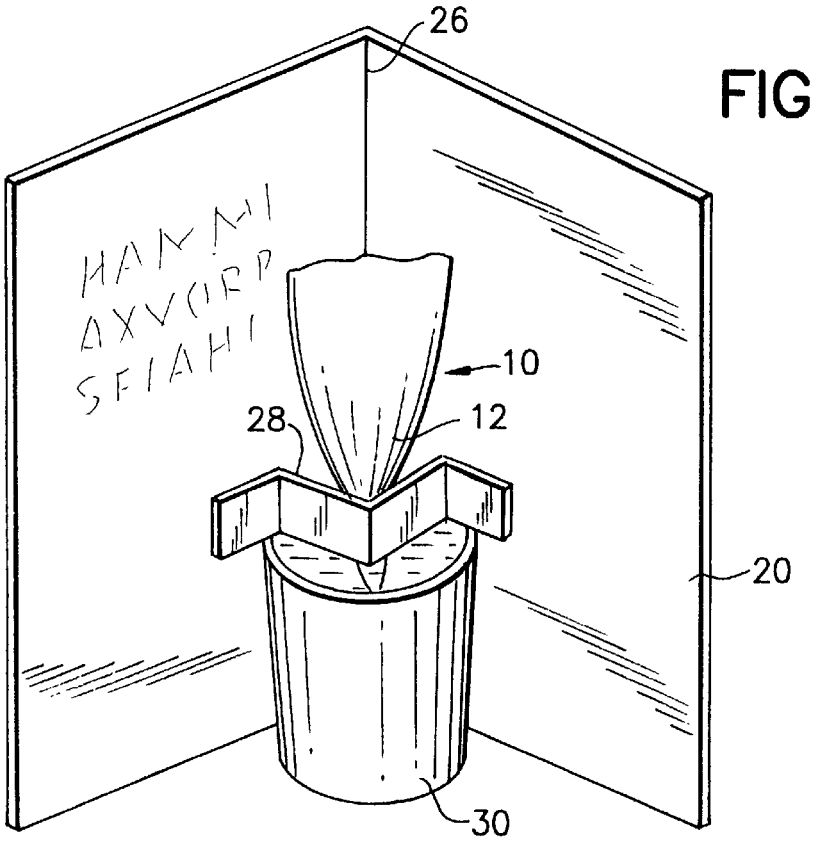
FIG. 4 shows the combination of FIG. 2 with the stem immersed in a small glass of water and with the seed pocket opened up to permit growth of seeds within the pocket.

FIG. 4 illustrates that a small drinking glass or cup 30 may be positioned under the support 28 close in to the hinge line 26 when the card 20 is on display. In this position it receives the lower end of the floral assembly 10.

When the greeting card is received by a convalescent patient or other recipient, it may be taken out of its envelope and opened as shown in FIG. 2. Thereafter, the flower may be removed from its support and the upper portion may be moistened lightly as by dipping it for an instant in water, and the flower may be returned to its place in support 28. The card may be raised and a cup 30 moved into position so that the stem may be lowered in the water in the cup. The upper end of flap 16 may be unseated so that the bloom-shaped seed pocket is opened at the top (FIG. 4). Water will be drawn up by capillary action through the stem to continue moistening the seed pocket, and after as little as 24 hours, the seeds will begin to germinate.

It should be understood that it is not necessary for the seeds to replicate the imitation flower. Any quick germinating seeds will be more than satisfactory. For instance, I have used radish seeds which germinate in 1–2 days; zinnia seeds, somewhat slower, are effective as well. Obviously, the quicker the germination, the sooner the recipient's interest will be heightened.

A nutrient in the form of powder or crystals can be added into the part of the filter paper blank which becomes the stem. When the stem is immersed, the nutrient will dissolve and be drawn up to feed the seeds.

Figure 5:
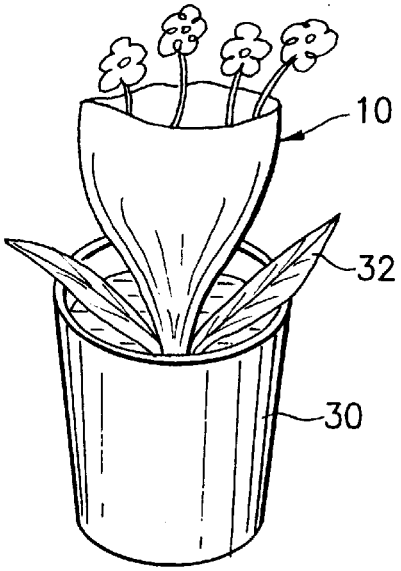
FIG. 5 is a modified form of the invention in which the stem is provided with artificial leaves and the leaves help support the floral assembly.

FIG. 5 illustrates that leaves 32, also of absorbent paper and possibly of different color from the bloom portion 10, may be usefully employed to help support the floral assembly in the cup 32. Thus, it is not necessary to have the card 20 continuously used as a support for the assembly.

Figure 6:
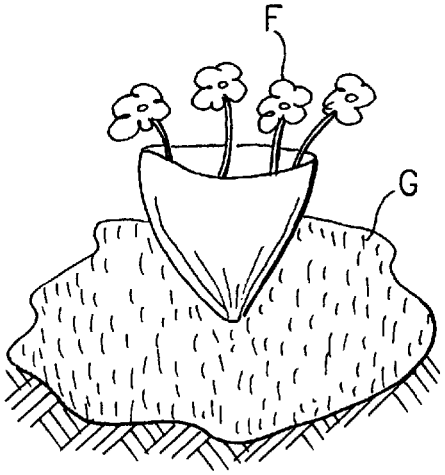
FIG. 6 shows a germinated assembly transplanted from the combination of FIG. 4 to a growing site in soil.

FIG. 6 suggests that the floral assembly 10, once the seedlings F have germinated, may be transferred to soil G and there to continue growth. The paper portions will eventually become less noticeable.

The floral assembly of the invention is suitable for sending to anyone, but it is particularly adapted for sending to convalescent home patients, for instance, who are always anxious for any development in the microcosm of their room. The floral assembly of the invention has proved consistently effective in the germination of seeds. It can be effectively employed in combination with a greeting card as described, or can be used in a drinking glass by itself.

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. A greeting card assembly comprising:

a. a card having a pair of panels having lower ends and being folded at a vertical-hinge line and having an open and a closed condition, and a retaining arm spaced above the lower ends of the panels and secured to at least one of the panels and adapted when the card is in the open condition to have a portion spaced out from the panels, and b. a floral assembly disposed between the panels and engaging and at least partly supported by the arm, the floral assembly comprising a seed-germinating receptacle in the form of a flattenable artificial flower and having an upper end and a lower end, the upper end being a flared bloom-shaped seed pocket made of absorbent paper, the lower end being a stem-shaped support also made of absorbent paper, and a seed disposed in the seed pocket, the assembly being flattened when the panels are in closed condition, and c. with the panels in the open condition, a container of water disposed under the arm and receiving in the water the lower end of the floral assembly to dampen the seed by capillary action of the absorbent paper drawing water up from the container to the seed pocket.

2. A greeting card assembly as claimed in claim 1 wherein the stem-shaped support is held in shape by a winding of stiff thin metal wire.

* * * * *